US006165007A

United States Patent [19]

Higuchi et al.

[11] Patent Number: 6,165,007

[45] Date of Patent: Dec. 26, 2000

[54] CABLE CONNECTOR CAPABLE OF RELIABLY CONNECTING A CABLE AND A METHOD OF CONNECTING THE CABLE TO THE CABLE CONNECTOR

[75] Inventors: Koji Higuchi, Kodaira; Osamu Hashiguchi, Akishima; Hisashi Ishida; Masahiro Yamauchi, both of Tokyo, all of Japan

[73] Assignees: Japan Aviation Electronics Industry, Limited; NEC Corporation, both of Tokyo, Japan

[21] Appl. No.: 09/440,748

[22] Filed: Nov. 16, 1999

[30] Foreign Application Priority Data

Nov. 17, 1998 [JP] Japan ..... 10-326315

[51] Int. Cl.[7] ..... H01R 9/07

[52] U.S. Cl. ..... 439/492; 439/492

[58] Field of Search ..... 439/492, 67, 77, 439/660, 496, 495, 494, 499

[56] References Cited

U.S. PATENT DOCUMENTS

| | | | |
|---|---|---|---|
| 3,154,365 | 10/1964 | Crimmins | 339/176 |
| 3,696,319 | 10/1972 | Olsson | 339/17 F |
| 4,023,877 | 5/1977 | Hennessey et al. | 339/17 F |
| 4,749,371 | 6/1988 | Hirai et al. | 439/497 |
| 5,044,980 | 9/1991 | Krumme et al. | 439/496 |
| 5,080,595 | 1/1992 | Mouissie | 439/67 |
| 5,100,342 | 3/1992 | Olsson | 439/497 |
| 5,240,420 | 8/1993 | Roberts | 439/62 |
| 5,308,262 | 5/1994 | Chishima | 439/495 |
| 5,525,072 | 6/1996 | Kunishi | 439/495 |
| 5,564,931 | 10/1996 | Fabian et al. | 439/62 |

FOREIGN PATENT DOCUMENTS

H02-8389 2/1990 Japan .

OTHER PUBLICATIONS

Japanese document No. 2–2389 which is mentioned in the specification, p. 1, line 7, counting from "Background". The pertinence of this document is explained in p. 1, et seq.

*Primary Examiner*—Gary F. Paumen
*Assistant Examiner*—Phuongchi Nguyen
*Attorney, Agent, or Firm*—Laff, Whitesel & Saret, Ltd.; J. Warren Whitesel

[57] ABSTRACT

In a cable connector (1) for connecting a cable (2) having a plurality of core wires (2*a*,2*b*), a plurality of support contacts (7) are held by a cover member (3) and extend in a first direction, the core wires are in close contact with the support contacts, respectively, a plurality of base contacts (8) are held by a base member (4) and clamp the core wires over the support contacts, respectively, in a second direction perpendicular to the first direction, the cover member covers the cable and is removably coupled to the base member.

7 Claims, 9 Drawing Sheets

CABLE CONNECTOR CAPABLE OF RELIABLY CONNECTING A CABLE AND A METHOD OF CONNECTING THE CABLE TO THE CABLE CONNECTOR

BACKGROUND OF THE INVENTION

The present invention relates to a cable connector for use in connecting a cable and to a method of connecting the cable to the cable connector.

Conventionally, various cable connectors have been proposed of which an example described in the Japanese Utility Model Publication No. H02-8389 will be outlined in the following, with reference to FIGS. 1A and 1B.

A cable connector of FIG. 1A comprises a contact housing 21 of synthetic resin, a cable housing 22 of synthetic resin, and a cover member 23 of synthetic resin. A flat cable 25 has core wires 26 and is previously passed through a slit 24 of the cover member 23. The cable housing 22 holds exposed tips of the core wires 26 and is inserted into a rear inner space 37 of the contact housing 21. Then, by engaging the recesses 29 of respective engaging strips 28 at both sides of the cover member 23 with respective protrusions 30 at both sides of the contact housing 21, the cable housing 22 and the contact housing 21 are fitted together as shown in FIG. 1B.

The core wires 26 are extended along the cable housing 22. A plurality of contact members 31 are arranged on the contact housing 21. Each of the contact members 31 is made of metal to have a U-shaped portion 31*a*. The distance between an upper portion and a lower portion of each of the core wires 26 is made slightly larger than the distance between two tips of the U-shaped lead 31A of each of the contact members 31. As a result, when the cable housing 22 and the contact housing 21 are fitted together, the core wires 26 are pressed against the U-shaped leads 31A of the contact members 31, respectively.

After the fitting is completed, a wire-cutting edge (not shown) is inserted through each of holes 38 of the contact housing 21 to cut off the tips of the core wires 26.

In the conventional cable connector, the core wires 26 are pressed against the cable housing 22 the contact members 31, respectively. However, this conventional structure and method cannot cope with the cable connectors of today where the intervals between contacts are becoming rapidly smaller. These small pitch contacts require small diameter core wires which are sometimes as small as 0.1 mm. It is difficult to press such a thin wires with contacts against the contact housing made of synthetic resin, and the connection between the core wires and the contacts tends to lack in reliability and stability.

SUMMARY OF THE INVENTION

It is an object of this invention to provide a cable connector which is capable of reliable connecting a cable.

It is still another object of this invention to provide a cable connector of the type described, which can cope with the small pitch contacts in a cable connector.

It is yet another object of this invention to provide a cable connector of the type described, in which it provides high reliability in connection.

It is a further object of this invention to provide a cable connector of the type described, in which it does not require difficult operation in the assembly process.

It is a still further object of this invention to provide a cable connector of the type described, in which the connection of multiple wires can be accomplished at once.

It is a yet further object of this invention to provide a cable connector of the type described, which is capable of providing decreased cross talk generation and good electrical properties.

It is an additional object of this invention to provide a cable connector of the type described, in which multiple core wires can be reliably connected with corresponding multiple base contacts.

It is a still additional object of this invention to provide a cable connector of the type described, in which the problem of wire protrusion from the cable connector is eliminated.

It is another object of this invention to provide a method of connecting the cable to the cable connector.

Other objects of the present invention will become clear as the description proceeds.

According to the present invention, there is provided a cable connector for connecting a cable having a plurality of core wires. The cable connector comprises a cover member for covering said cable, a plurality of support contacts held by said cover member and extending in a first direction, said core wires being in close contact with said support contacts, respectively, a base member removably coupled to said cover member, and a plurality of base contacts held by said base member and clamping said core wires onto said support contacts, respectively, in a second direction perpendicular to said first direction.

It may be arranged that each of said support contact has electrical conductivity, each of said base contacts having electrical conductivity and adapted to be connected to a mating connector.

It may be arranged that each of said base contacts has a pair of leads spaced to each other in said second direction, each of said support contacts being inserted between said leads of each of said base contact, each of said core wires extending between each of said leads of each of said base contact and each of said support contacts.

It may be arranged that each of said core wires is folded over each of said support contacts, each of said base contacts having a U-shaped portion which is fitted over each of said core wires to come in contact with each of said core wire at two points.

It may be arranged that said cover member has a plurality of partition walls which are at both sides of said support contact and opposite to each other in a third direction perpendicular to said first and said second direction, each of said base contacts being inserted between said partition walls.

It may be arranged that said core wires have signal wires and drain wires arranged alternately.

According to the present invention, there is provided a method of connecting a cable, having a plurality of core wires, to the above-mentioned cable connector. The method comprises the steps of making said cable have a half-stripped portion in which said core wires are exposed, folding said core wires over said support contacts, respectively, coupling said base member with said cover members to make said base contacts press said core wires onto said support contacts, respectively, and cutting off the tips of said core wires outside of said base members. It may be arranged that the cutting step is carried out on the way of performing the coupling step.

BRIEF DESCRIPTION OF THE DRAWING

FIGS. 1A and 1B illustrate a conventional cable connector, in which FIG. 1A is a plan view showing the state before a contact housing and a cover member are fitted with each other and FIG. 1B is a cross sectional view showing the state after the fitting;

DESCRIPTION OF THE PREFERRED EMBODIMENT

An embodiment of the cable connector of the present invention will be described in the following, with reference to FIG. 2 through FIG. 10.

Figure 1A:
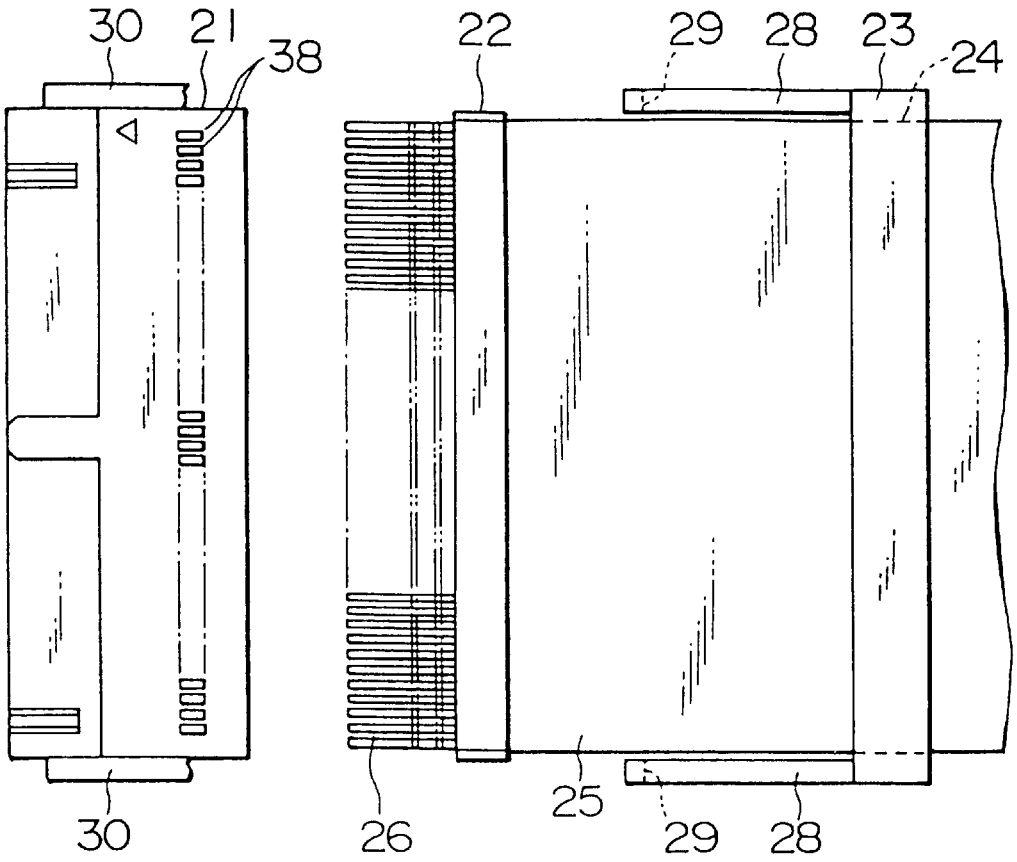
FIG. 1A PRIOR ART
Figure 1B:
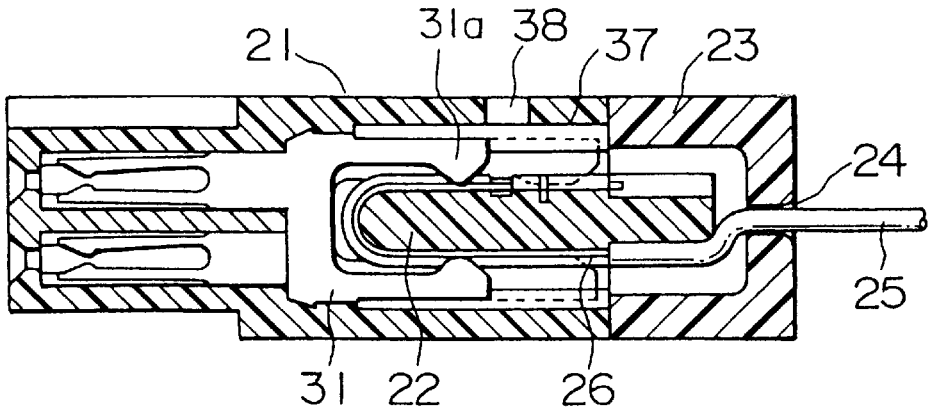
FIG. 1B PRIOR ART
Figure 2:
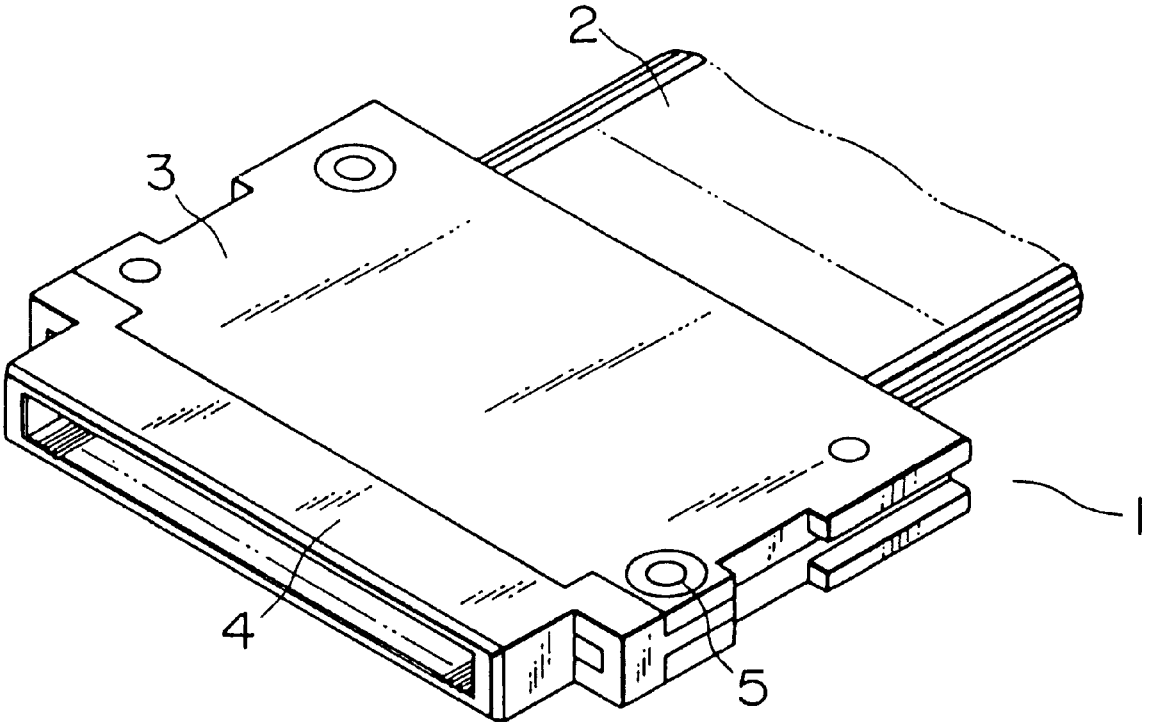
FIG. 2 is a perspective view of a cable connector according to an embodiment of the present invention.
Figure 3:
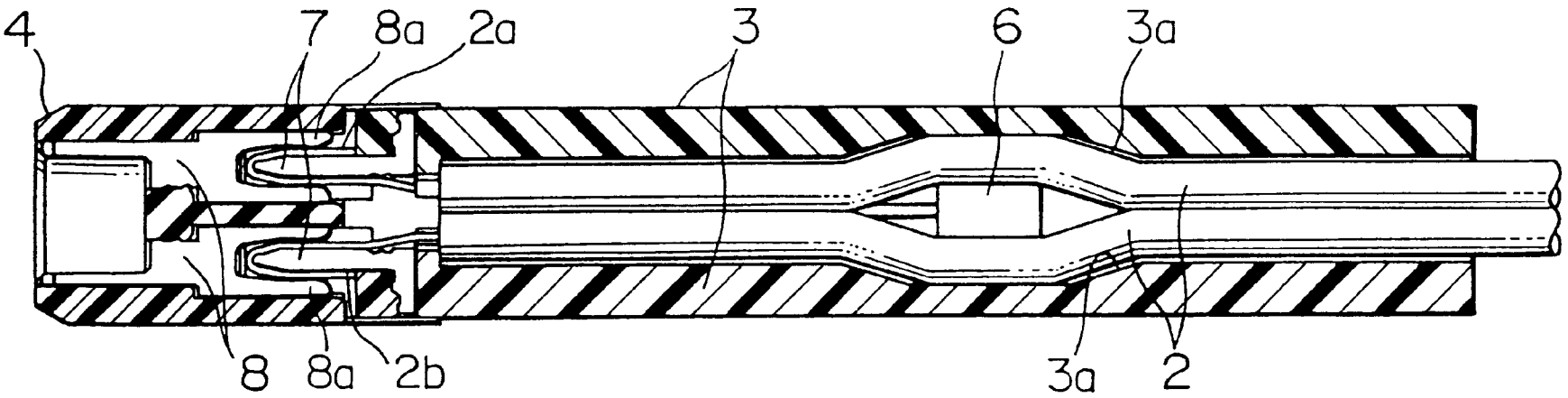
FIG. 3 is a cross-sectional view of the cable connector of FIG. 2.
Figure 4:
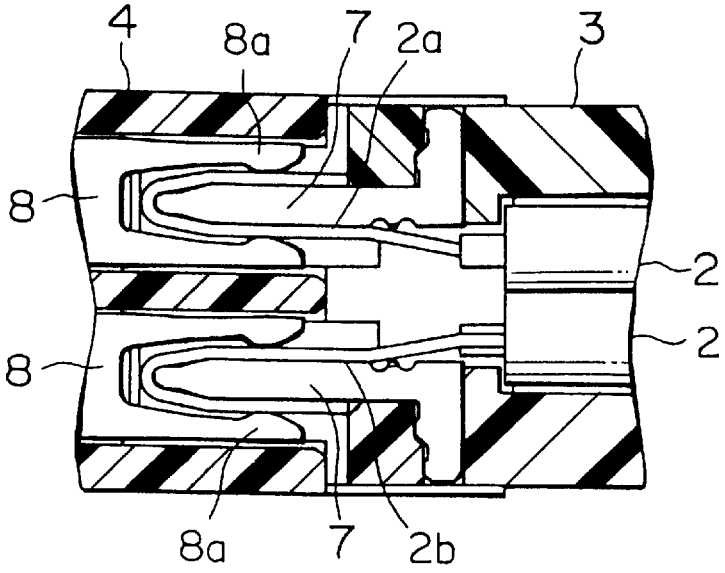
FIG. 4 is a cross sectional view of a cable-connecting region in the cable connector of FIG. 2.

Referring to FIGS. 2–4, a cable connector 1 is for connecting upper and lower coaxial cables 2 and comprises upper and lower cover insulators 3 clamping the coaxial cables 2, a base insulator or a base member 4 removably coupled to the cover insulators 3, a plurality of support contacts 7 held by the cover insulators 3, and a plurality of base contacts 8 held by the base insulator 4. The base insulator 4 and the two cover insulators 3 are fixed together with four screws 5. A combination of the upper and the lower cover insulators 3 is referred to as a cover member for covering the coaxial cables 2.

Each of the support contacts 7 extends in a left and right direction or a first direction. The coaxial cables 2 have a plurality of core wires 2*a* and 2*b* which extend around the support contacts 7 to be in close contact with the support contacts 7, respectively. In the manner which will later be described, the base contacts 8 press the core wires 2*a* and 2*b* onto the support contacts 7 in an upper and lower direction or a second direction perpendicular to the first direction.

Each of the upper and the lower cover insulators 3 is made of synthetic resin. The base insulator 4 is made of synthetic resin. Each of the support contacts 7 is made of metal to have electrical conductivity. Each of the base contacts 8 is made of metal to have electrical conductivity.

A spacer 6 is a plate member made of rubber or other material and is inserted between upper and lower coaxial cables 2. The spacer 6 is held between recesses 3*a* of upper and lower cover insulators 3, thus preventing each coaxial cable 2 from escaping out of the cover insulators 3.

Each of the cover insulators 3 incorporates the support contacts 7 onto which the core wires 2*a* and 2*b* of each coaxial cable 2 are folded over, respectively. These wires 2*a* and 2*b* may be fixed the support contacts 7 by means of welding or soldering. The core wires 2*a* and 2*b* will be called signal wires and drain wires, respectively. The base contacts 8 are incorporated in the base insulator 4. Each of the base contacts has U-shaped portion 8*a* having a pair of leads spaced to each other in the second direction. The U-shaped portion 8*a* clamp the signal wires 2*a* and the drain wires 2*b* as well as the support contacts 7 with strong contacting force at two contacting points. With this structure, two coaxial cables 2 with identical structure are laid one over another, but with their sides reversed relative to each other. Consequently, the signal wires 2*a* and the drain wires 2*b* are arranged alternately, in regard to both the direction parallel to the paper surface and the direction perpendicular to the paper surface. This arrangement decreases the cross talk generation.

Figure 5:
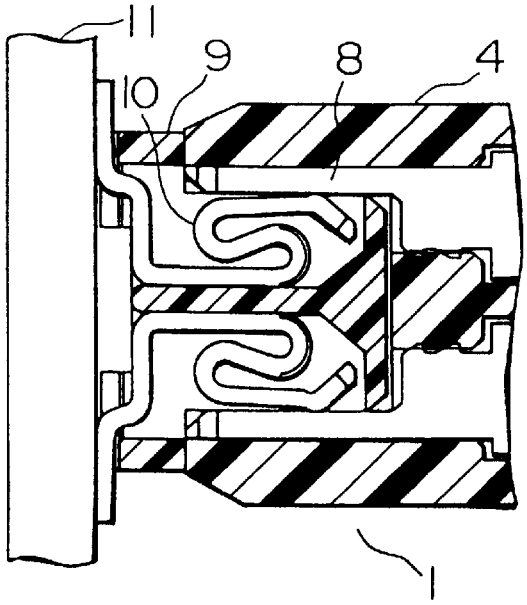
FIG. 5 is a cross sectional view of a major portion in a state that the cable connector of FIG. 2 is fitted with a mating connector.

Referring to FIG. 5, the cable connector 1 is connected to a mating connector 9 in the manner known in the art. The mating connector 9 is already mounted on a printed circuit board 11. On fitting the cable connector 1 with the mating connector 9, the respective base contacts 8 are connected electrically with respective contacts 10 of the mating connector 9.

Figure 6A:
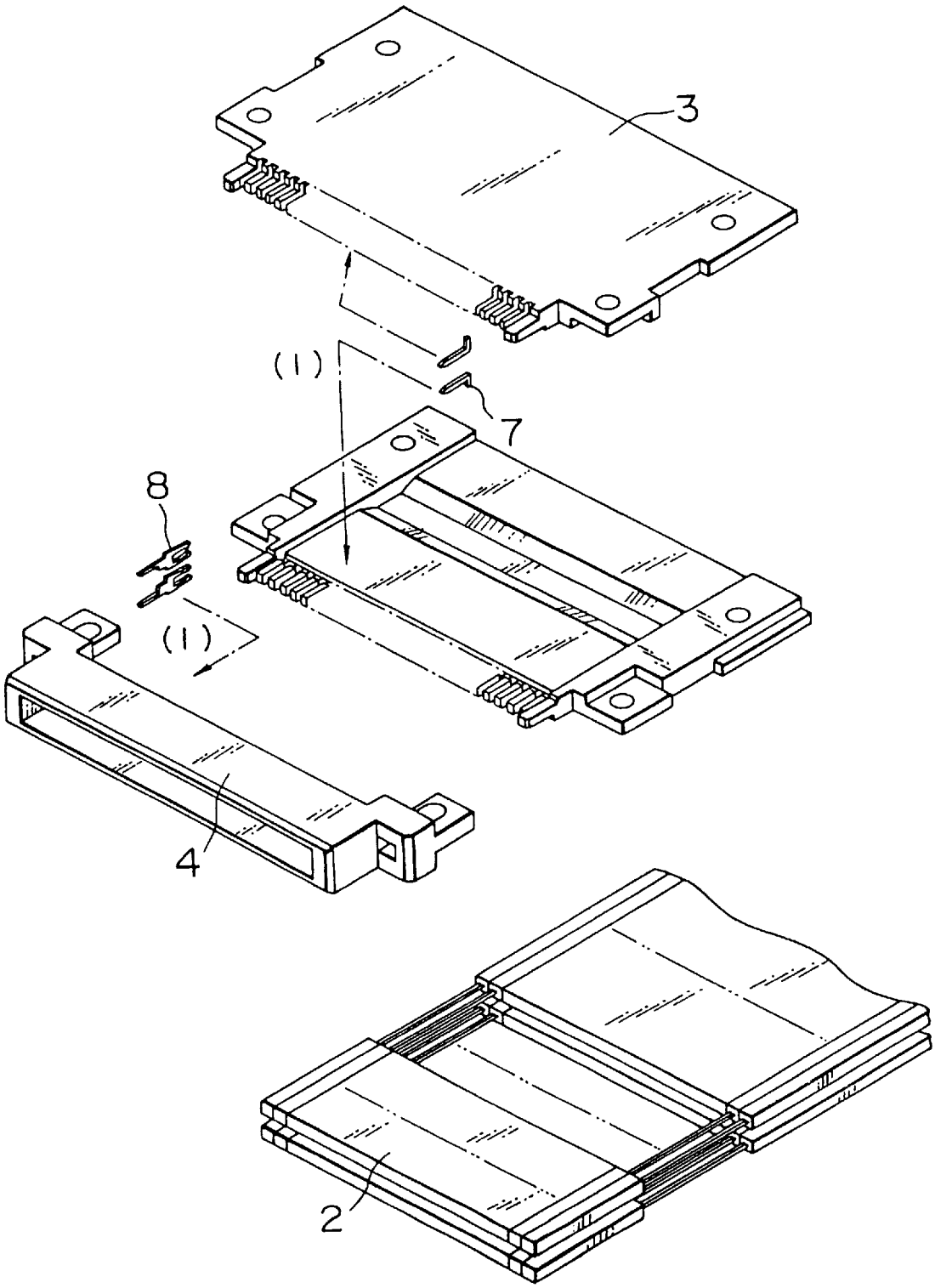
FIGS. 6A, 6B and 6C are a perspective view showing the assembly process of a cable connector of FIG. 2.
Figure 6B:
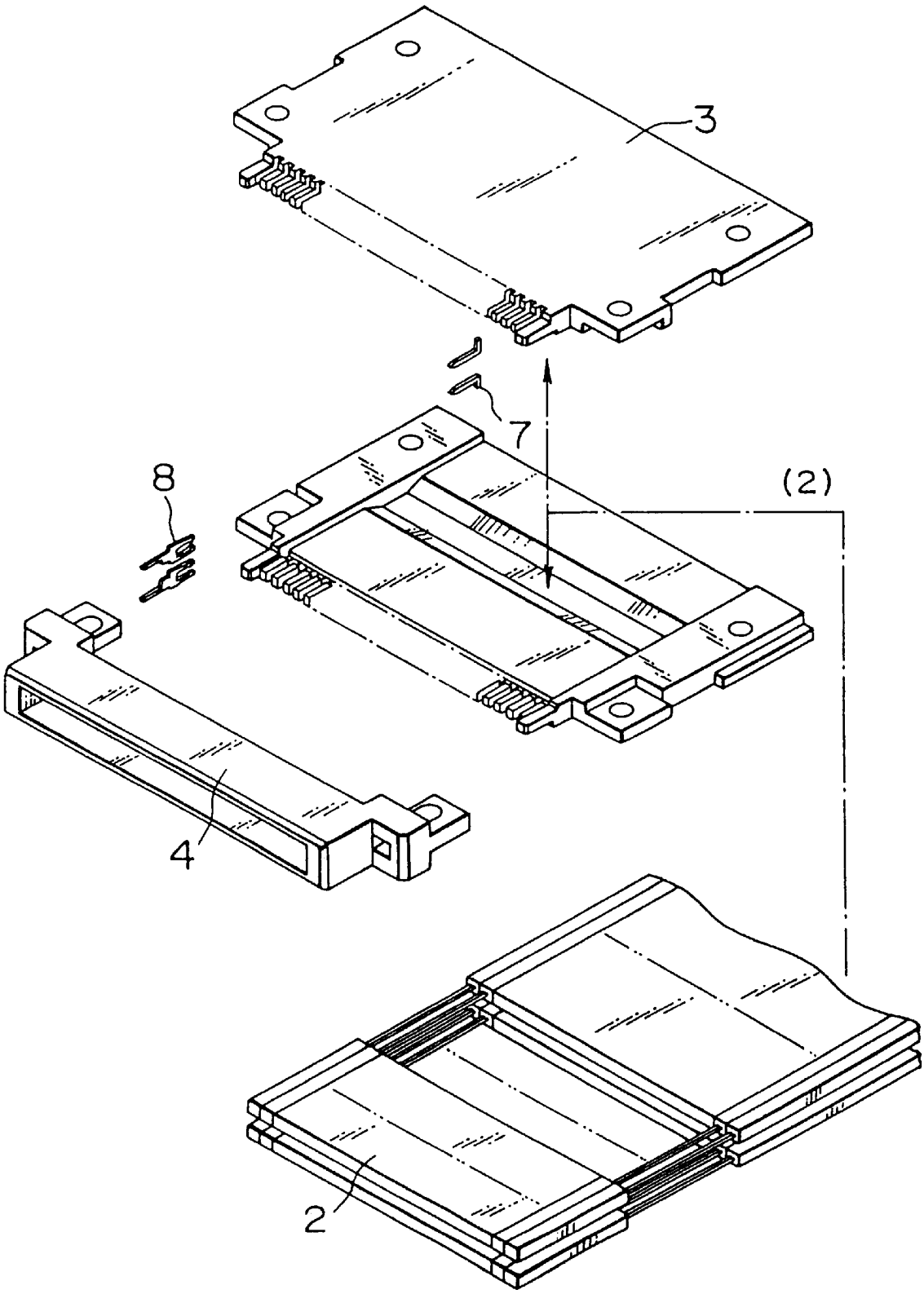
Figure 6C:
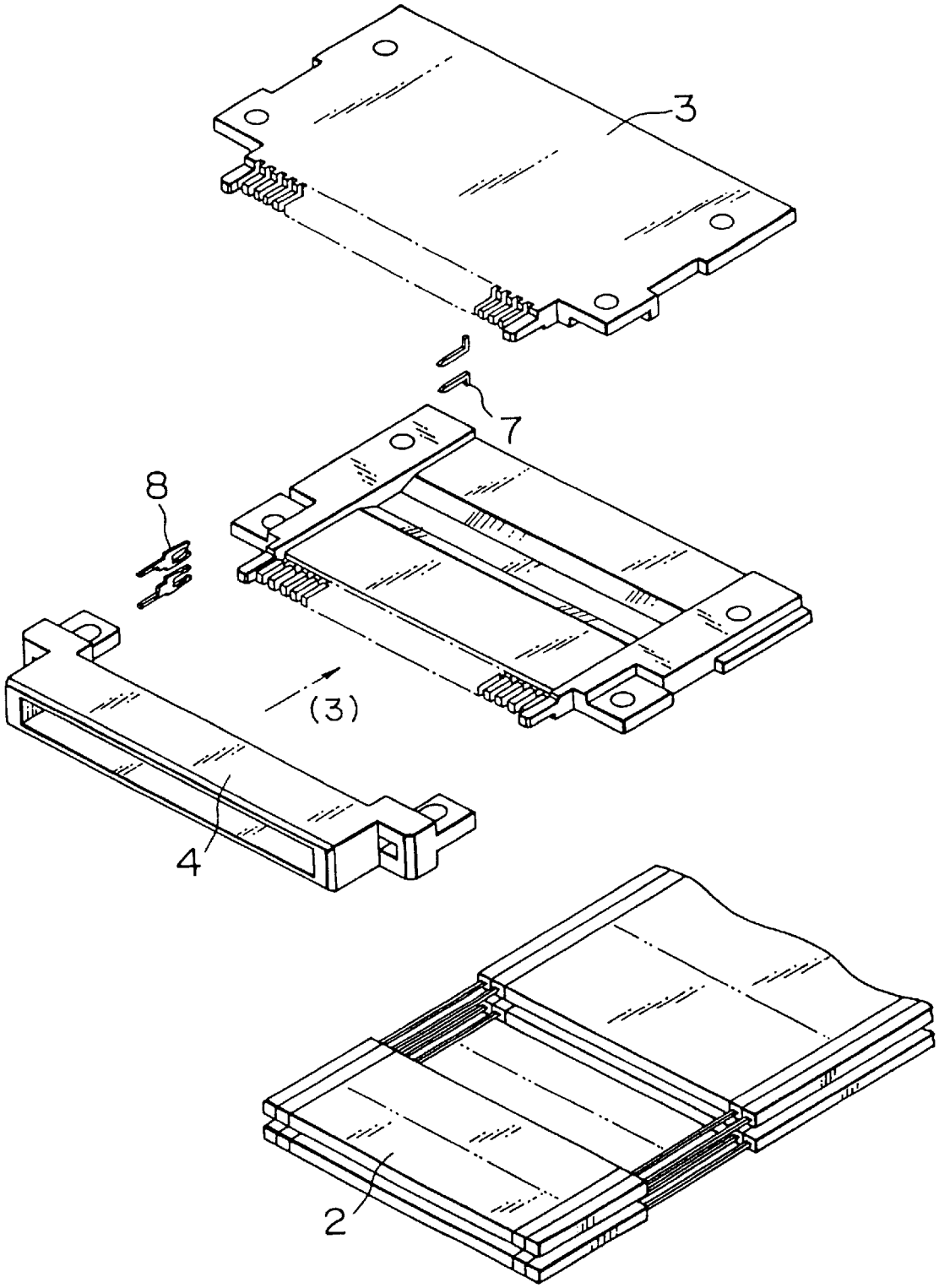

With reference to FIG. 6, the description will be made as regards an assembling process of the cable connector 1.

In the first step (1), the respective support contacts 7 are incorporated in the respective cover insulators 3. Also, the respective base contacts 8 are incorporated in the base insulator 4.

Figure 7:
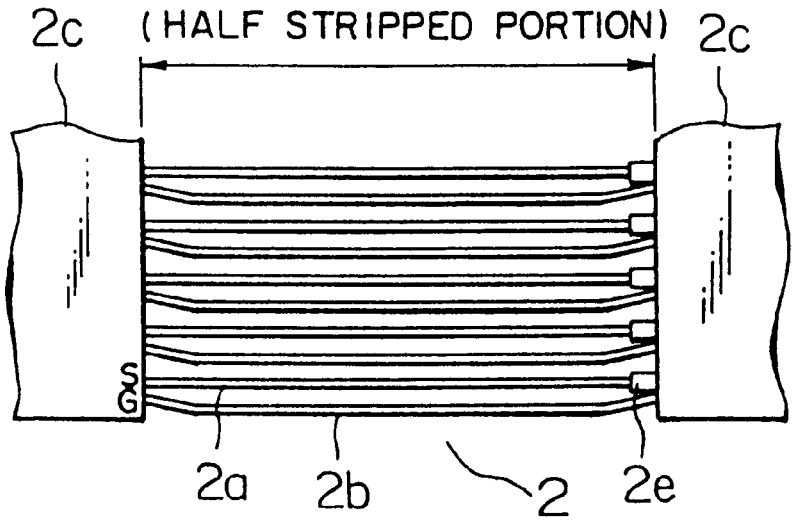
FIG. 7 is a cross-sectional view showing an arrangement of core wires of a cable capable of being connected to the cable connector of FIG. 2.
Figure 8:
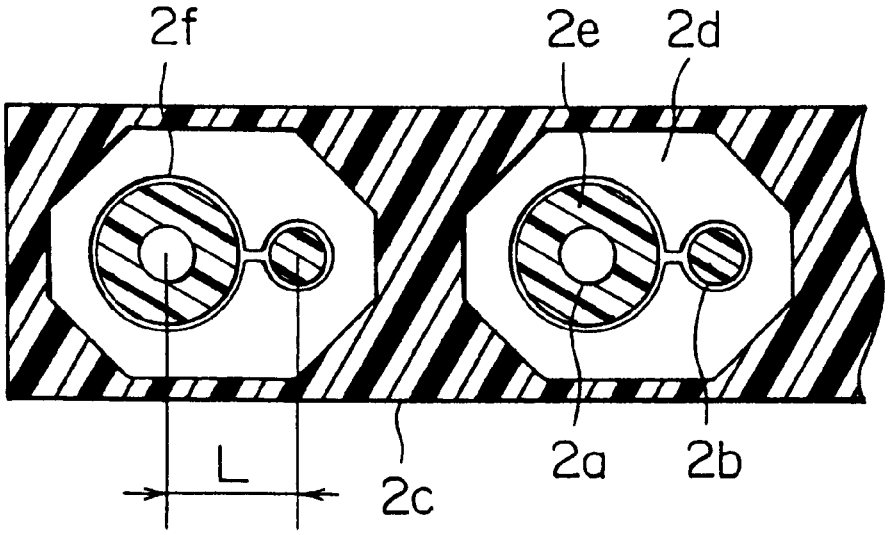
FIG. 8 is a cross sectional view of a coaxial cable capable of connected to the cable connector of FIG. 2.

In the second step (2), the two coaxial cables 2 laid one over another are clamped between the upper and lower cover insulators 3 which are fixed at two points (located farther from the base insulator 4 with two screws 5. To expose the signal wires 2*a* and the drain wires 2*b* as shown in FIG. 7, the respective coaxial cables 2 have been half-stripped beforehand in the manner known in the art. After that, the wires 2*a* and 2*b* are separated at equal intervals. A sheath 2*c* of the coaxial cable 2 is made of UV curable resin or film as shown in FIG. 8. The sheath 2*c* has multiple bores 2*d* at equal intervals to accommodate the signal wires 2*a* and the drain wires 2*b* therein. The signal wires 2*a* are coated with dielectric substance 2*e*. The drain wires 2*b* and dielectric substance 2*e* are coated with shields 2*f*. A structure is adopted in which the interval L between the signal wire 2*a* and the drain wire 2*a* is made larger than usual, in order to facilitate the forming operation in which the signal wires 2*a* and the drain wires 2*b* are folded over onto the support contacts 7, respectively.

Figure 9:
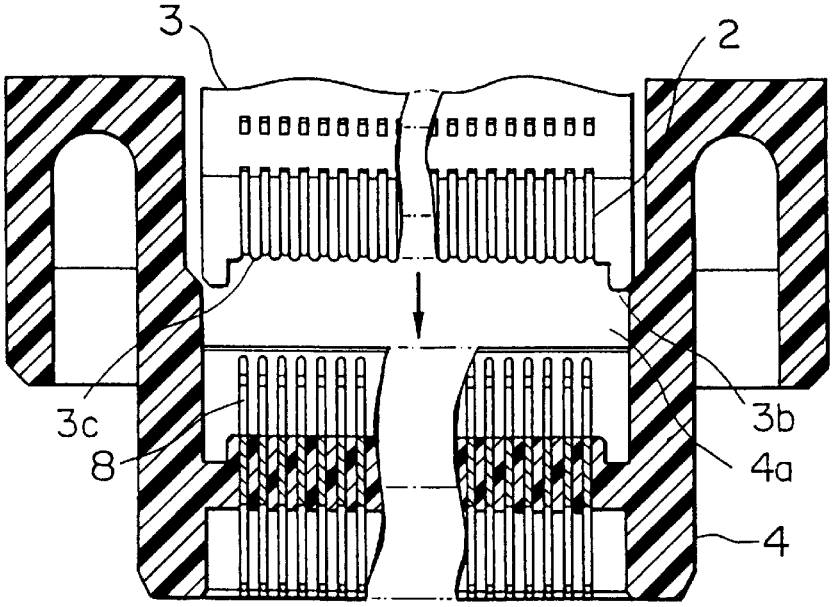
FIG. 9 is a sectional view illustrating the guiding during the fitting operation of a base insulator and two cover insulators in the cable connector of FIG. 2.
Figure 10:
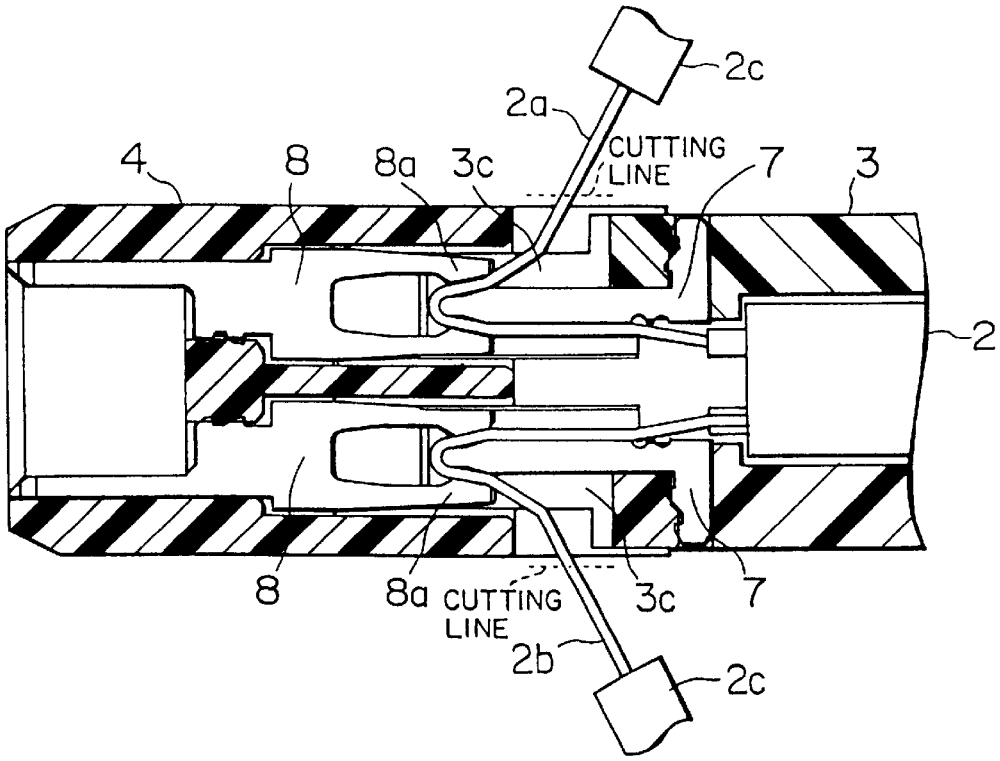
FIG. 10 is a sectional view illustrating the cutting of the core wires during the fitting operation of the base insulator and the two cover insulators in the cable connector of FIG. 2.

Next, the signal wires 2*a* and the drain wires 2*b* are folded over onto the respective support contacts 7. The cover insulator 3 has a plurality of partition walls 3*c* as shown in FIGS. 8 and 9. The partition walls 3*c* are located at both sides of each of the support contacts 7 and opposite to each other in a third direction perpendicular to the first and the second direction. The partition walls 3*c* protrude higher than the signal wires 2*a* and the drain wires 2*b* in order that the wires do not leave the respective support contacts 7. Each of the base contacts 8 is inserted between the partition walls 3*c*.

In the third step (3), the respective signal wires 2*a* and the respective drain wires 2*b* can be connected simultaneously with the respective base contacts 8, by fitting the base insulator 4 with the two cover insulators 3. As shown in FIG. 9, the cover insulators 3 are guided to a slot 4A by means of protrusions 3*b* which are provided at both sides of the cover insulators 3, respectively. There are little clearance between both sides of the cover insulators 3 and inside of the slot 4*a* of the base insulator 4, thus preventing the positional deviation in the lateral direction at the fitting. When the cover insulators 3 are inserted into the base insulator 4, the respective base contacts 8 are guided into the respective intervals or channels between the partitions 3*c* of the cover insulators 3, causing the respective base contacts 8 to connect with the respective signal wires 2*a* and the respective drain wires 2*b*, without a pitch error. The signal wires 2*a* and the drain wires 2*b* are cut during the fitting operation as shown in FIG. 9. After the respective support contacts 7 are inserted into the respective base contacts 8 to some extent, the cutting of the signal wires 2*a* and the drain wires 2*b* at the location shown by dotted lines does not cause wires to come to disorder or to escape from the cable connector 1. Following the cutting operation, the respective support contacts 7 are inserted into the respective base contacts 8 as far as the position shown in FIG. 2. After completion of the fitting, the signal wires 2*a* and the drain wires 2*b* do not protrude from the base insulator 4. Finally, the base insulator 4 and two cover insulators 3 are fixed at two points by means of two screws 5.

While the present invention has thus far been described in connection with a few embodiments thereof, it will readily be possible for those skilled in the art to put this invention into practice in various other manners. For example, it is a matter of course that the cable connector can be used in connecting a single cable.

What is claimed is:

1. A cable connector for connecting a cable having a plurality of core wires, said cable connector comprising: a cover member for covering said cable;

a plurality of support contacts held by said cover member and extending in a first direction, each of said support contacts being electrically conductive, said core wires being in close contact with said support contacts, respectively;

a base member removably coupled to said cover member; and a plurality of base contacts held by said base member and clamping said core wires onto said support contacts, respectively, in a second direction perpendicular to said first direction, each of said base contacts being electrically conductive and adapted to be connected to a mating connector.

2. A cable connector as claimed in claim 1, wherein each of said base contacts has a pair of leads spaced to each other in said second direction, each of said support contacts being inserted between said leads of each of said base contact, each of said core wires extending between each of said leads of each of said base contact and each of said support contacts.

3. A cable connector as claimed in claim 1, wherein each of said core wires is folded over each of said support contacts, each of said base contacts having a U-shaped portion which is fitted over each of said core wires to come in contact with each of said core wire at two points.

4. A cable connector as claimed in claim 1, wherein said cover member has a plurality of partition walls which are at both sides of said support contacts and opposite to each other in a third direction perpendicular to said first and said second direction, each of said base contacts being inserted between said partition walls.

5. A cable connector as claimed in claim 1, wherein said core wires have signal wires and drain wires arranged alternately.

6. A method of connecting a cable, having a plurality of core wires, to a cable connector as claimed in claim 1, said method comprising the steps of:

making said cable have a half-stripped portion in which said core wires are exposed;

folding said core wires over said support contacts, respectively;

coupling said base member with said cover members to make said base contacts press said core wires onto said support contacts, respectively; and cutting off the tips of said core wires outside of said base members.

7. A method as claimed in claim 6, wherein the cutting step is carried out on the way of performing the coupling step.

* * * * *